United States Patent [19]

Roberts

[11] Patent Number: 4,854,293

[45] Date of Patent: Aug. 8, 1989

[54] ARCHERY BOWSTRING DRAWBACK AND RELEASE DEVICE

[75] Inventor: Kent S. Roberts, American Fork, Utah

[73] Assignee: Roberts Mfg., Inc., American Fork, Utah

[21] Appl. No.: 250,558

[22] Filed: Sep. 29, 1988

[51] Int. Cl.[4] ..... F41B 5/00

[52] U.S. Cl. ..... 124/35 A

[58] Field of Search ..... 124/31, 35 R, 35 A, 124/36; 74/2, 501.6

[56] References Cited

U.S. PATENT DOCUMENTS

| | | | |
|---|---|---|---|
| 3,010,446 | 11/1961 | Frantello | 124/35 A |
| 4,151,825 | 5/1979 | Cook | 124/35 A |
| 4,257,386 | 3/1981 | Gazzara | 124/35 A |
| 4,620,523 | 11/1986 | Peck | 124/35 A |
| 4,674,469 | 6/1987 | Peck | 124/35 A |

*Primary Examiner*—Randolph A. Reese
*Assistant Examiner*—John Ricci
*Attorney, Agent, or Firm*—Philip A. Mallinckrodt; Robert R. Mallinckrodt

[57] ABSTRACT

The bowstring drawback and release device of the invention has a handle member that is advantageously of comfortably contoured T-formation in which the stem of the T extends forwardly and is connected by ball and socket joinder to a support for a bowstring catch. The support is in the form of a housing that is desirably open at its forward end and along its bottom, the catch being a lever within and pivoted to the housing intermediate its ends so as to drop open upon release effected by pulling a resiliently biased trigger that is pivoted within the housing and extends outside for convenient pulling, as by the thumb of the hand of an archer holding the handle. An important feature is the provision of a transversely segmented, longitudinal, composite rod having a laterally confined, rigid, forward end segment that is adapted to engage a rearwardly shouldered portion of the catch for holding the bowstring in engaged drawback position and a laterally unconfined, rearward end segment of stiffly flexible material connected to the trigger for accommodating any misalignment of the handle member when the trigger is pulled.

10 Claims, 1 Drawing Sheet

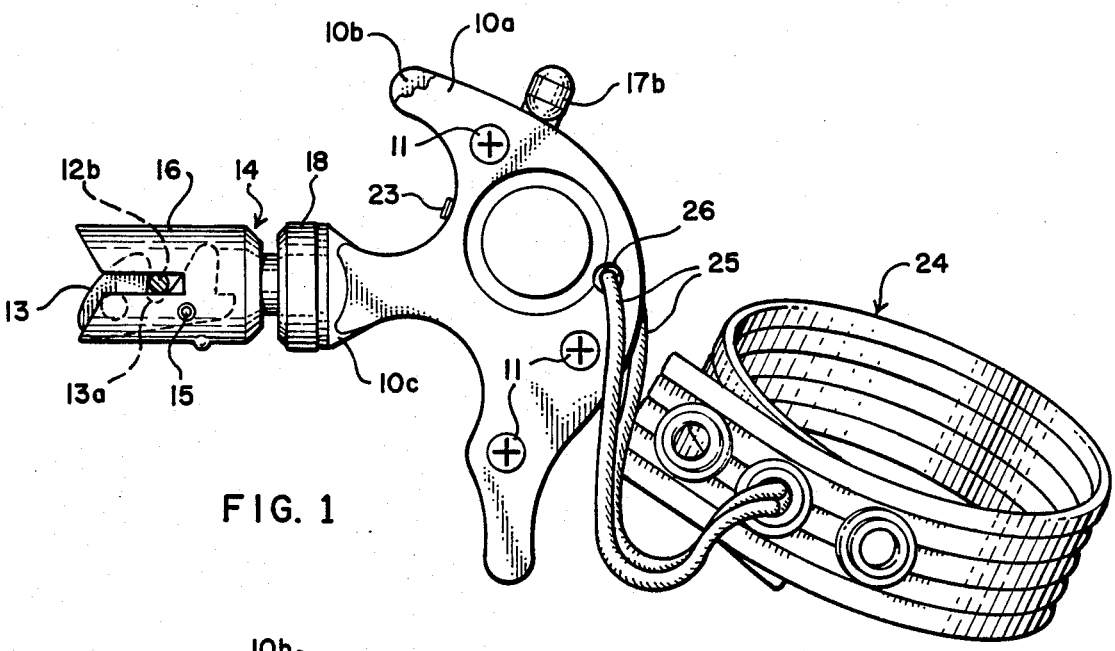
FIG. 1
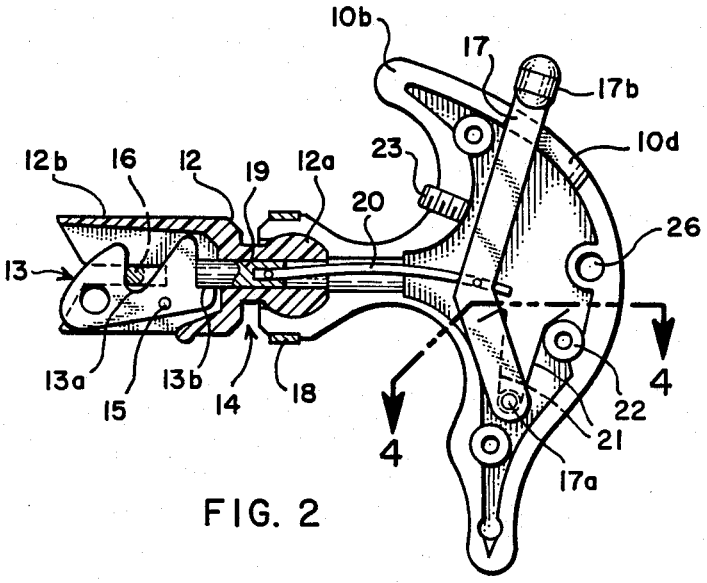
FIG. 2
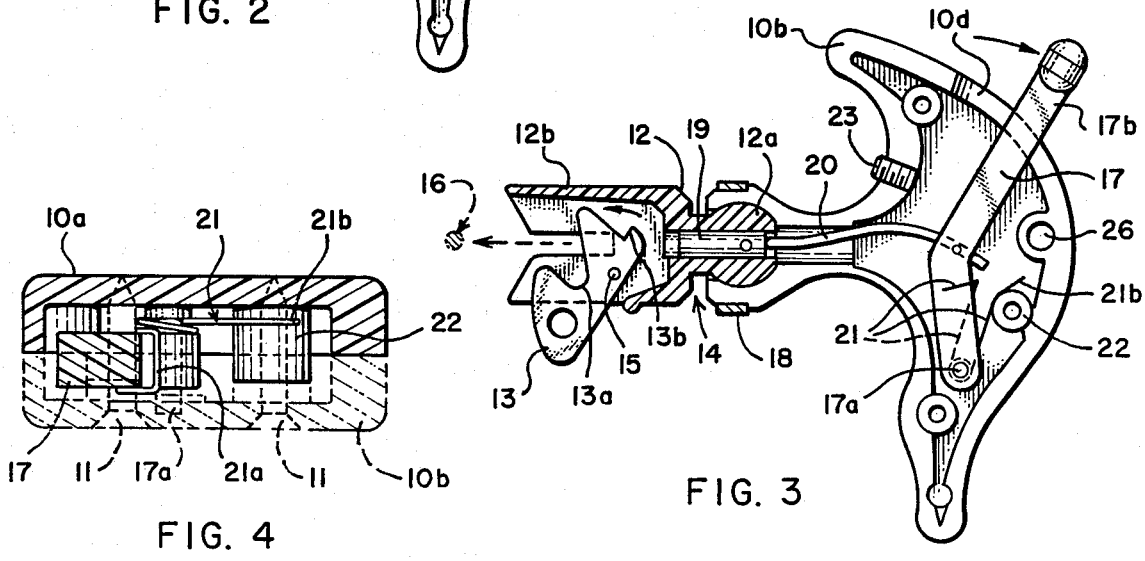
FIG. 3
FIG. 4

ARCHERY BOWSTRING DRAWBACK AND RELEASE DEVICE

BACKGROUND OF THE INVENTION

1. Field

The invention is in the field of archery bowstring drawback and release devices having a trigger for pulling by an archer after drawback to release engagement with the bowstring and to thereby shoot an arrow.

2. State of the Art

The sport of archery has spawned numerous developments in bows and auxiliary equipment. With the advent of the now immensely popular compound bow, drawing the bowstring back for shooting an arrow has required considerable strength, even though little strength is required to hold the string as drawn in position for aiming and release. To facilitate drawing back of the bowstring, various drawback devices with trigger releases have been developed. One of these, shown by Cook U.S. Pat. No. 4,151,825, purports to prevent inadvertant twisting of the bowstring on drawback by providing universal movement between an arrow and the bowstring drawback device to accommodate any lateral movement of the device during drawback.

SUMMARY OF THE INVENTION

The present invention is concerned with providing a comfortable and easy-to-use drawback device of simple and economical construction that eliminates the tendency in prior devices of an archer to inadvertantly twist the bowstring during drawback, resulting in an inaccurate shot.

In accordance with the invention, a string-engaging catch is pivotally mounted in a supporting member of bowstring-engaging structure, which is connected to a handle member in which a spring-biased trigger mechanism is mounted. The connection provides for universal movement between the string-engaging structure and the handle member. Bowstring release is achieved by a transversely segmented, longitudinal composite rod between trigger and catch, one end of which rod is normally held in place in the catch by spring biasing of the trigger and is released from the catch by bowstring tension when the trigger is pulled to overcome the spring biasing thereof and to pull the rod back from its catch-engaging position.

The composite nature of the rod not only provides for transverse movement of a flexible segment thereof in accommodating arcuate movement of the trigger relative to straight line, back and forth, reciprocative movement of the catch-engaging segment of the rod, but also enables the universal joinder of handle member to string-engaging structure to achieve the intended purpose of ensuring accuracy of shot by always maintaining proper alignment of the release mechanism with the bowstring regardless of any misalignment of the handle member. Thus, in accordance with the invention, the rod has a rigid, longitudinal, end segment connected to a stiffly flexible, longitudinal, opposite end segment, the rigid end segment being slidable back and forth in a confining slideway and arranged to engage the catch member, and the flexible portion being free to flex transversely as it executes back and forth longitudinal movement by reason of its connection with the trigger. The flexible portion of the rod is preferably made of an appropriate grade of nylon whose stiff flexibility permits the required transverse movement while still transmitting the required force longitudinally.

THE DRAWING

The best mode presently contemplated of carrying out the invention in actual practice is shown in the accompanying drawing in which:

FIG. 1 is a view showing the bowstring release device in side elevation, and a thereto attached wrist strap in perspective, with catch-engaged bowstring of an archery bow appearing in vertical transverse section ready to be drawn back by means of the device and with the trigger in place for pulling following the draw;

FIG. 2, a vertical section taken along the longitudinal axis of the device of FIG. 1 showing internal parts of the device in elevation;

FIG. 3, a view corresponding to that of FIG. 2 but taken after the trigger has been pulled and the bowstring released; and FIG. 4, a horizontal section taken on the line 4—4 of FIG. 2 drawn to a larger scale and showing the other half of the handle in phantom.

DETAILED DESCRIPTION OF THE ILLUSTRATED EMBODIMENT

As illustrated, the bowstring release device comprises a handle member 10 molded in rigid, longitudinal half sections **10*a* and 10*b* from a suitable rigid plastic material, and secured together as by screws 11. Each of the handle half sections 10*a* and 10*b* and the handle member 10 itself are of comfortably contoured T-formation for grasping and holding by the hand of an archer used for the draw, the stem 10*c*, FIG. 1, of such handle member having its free, i.e., forward, end formed as a socket, FIGS. 2 and 3, in which is received the ball-formed rear end portion 12*a* of a supporting member 12 for the catch 13 of bowstring-engaging structure 14**.

The opposite, i.e., forward, end portion **12*b* of the catch-supporting member 12 is here shown formed as a forwardly open-ended and open-bottomed housing, within which is pivotally mounted, at 15, the upwardly cradled and rearwardly and upwardly shouldered catch 13, with its bowstring-receiving cradle 13*a* arranged forwardly of its intermediate pivot point 15 so as to drop and release bowstring 16 when trigger 17 is pulled, usually by the thumb of the hand holding handle member 10. The two half sections of stem 10*c* of handle member 10 are held together by a ring 18 installed after ball 12*a* is in place, and trigger 17 is pivoted at its lower end as at 17*a***.

Catch 13 is normally held in bowstring-engaging position. FIGS. 1 and 2, by a resiliently biased, transversely segmented, longitudinal, composite rod, which, as here shown, comprises one rigid, longitudinal, end segment in the form of a pin 19 slidably extending through a receiving and laterally confining, slideway passagein ball portion **12*a* and extending on further through an adjoining intermediate portion 12*b* of catch-supporting member 12 so as to be pushable, by reason of its resilient biasing, into the interior of catch housing 12*b* and into engagement with the rearwardly and upwardly facing, stop shoulder 13*b* of catch 13, as shown in FIG. 2**.

To insure accuracy of arrow projection when shot following the draw, the other, longitudinal, end segment 20 of the composite rod is formed of stiffy flexible material, preferably a nylon plastic, and is laterally unrestrained, to accommodate any inadvertant transverse movement applied to the bowstring release device by the archer in drawing back the bowstring. The stiffly flexible material should have sufficient stiffness to push the forward end segment forwardly when the rearward end segment is urged forwardly by the resiliently biased trigger, but should be flexible enough to yield laterally so as to correct for any misalignment of handle member and bowstring release structure. While prior art purports to accomplish this by a double universal connection between members, the prior art construction is complicated and expensive, uncomfortable to use, and not entirely effective Here, the desired result is effectively accomplished by the nature of the structure interconnecting the trigger and release mechanism, without more.

Laterally unrestrained extension 20 of pin 19, i.e., the other longitudinal end segment, connects pin 19 with and secures it to trigger 17 in handle member 10. A commercial grade of nylon plastic, e.g., a premium quality, 0.095 diameter, monofilament, nylon trimmer line as used in grass trimmers and sold by Power Lawn Mower Parts, Inc. of Rochester, New York, under Part No. WL-095C, has been found to be well adapted for the purpose.

Trigger 17 is preferably an elongate element within handle member 10, having its lower end portion pivoted in the lower part of the cross member of the T of handle member 10 by means of a pivot pin 17*a*, connected intermediate its length to the forward end of flexible end segment 20 of the composite rod, and having its knobbed, manipulating end 17*b* projecting outwardly of handle member 10 through a slot 10*d* thereof.

As shown in FIG. 3, when trigger 17 is pulled against the resistance of trigger-biasing spring 21 to release pin 19 from its catch-engaging position, rod portion 20 buckles sufficiently to accommodate any transverse component of combined trigger and rod movements due to misalignment of handle member 10. Such spring 21 is preferably a torsion spring wrapped around pivot pin 17*a* of trigger 17 and having upstanding arms 21*a* and 21*b* bearing against trigger 17 and a boss 22, through which a screw 11 passes, respectively. Such spring serves to resiliently bias both trigger 17 and the composite rod 19, 20.

For adjusting the rest position of trigger 17 to suit different thumb lengths of individual users, a set screw 23 is advantageously provided so as to limit return travel of the trigger after each shot.

To guard against loss of the device by slipping from the hand of the archer upon release of an arrow, a wrist strap, shown at 24, FIG. 1, is preferably secured to handle member 10 by means of a tether cord 25 passed through a receiving opening 26 in such handle member.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A bowstring release device, comprising in combination bow string-engaging structure having string-engaging catch means pivotally mounted in a supporting member; a handle member; a ball and socket joint universally coupling said supporting member and said handle member together; a trigger pivotally mounted in said handle member; means resiliently biasing said trigger; a transversely segmented, longitudinal, composite rod extending between said trigger and said string-engaging catch means, one longitudinal end segment of said rod being rigid and adapted to engage said catch means, the other longitudinal end segment being stiffly flexible and secured to said trigger; slideway means laterally confining said rigid end segment of said composite rod; and resilient means acting against said trigger to normally urge said rigid end segment of said rod means into engagement with said catch means, said trigger being movable against the urge of said resilient means when pulled to withdraw said rigid end segment of said composite rod from said catch means for releasing the bowstring from said string holder, the said other end segment of the rod being unrestrained laterally and free to flex transversely while still transmitting movement longitudinally.

2. A device according to claim 1, wherein the supporting member is a forwardly open-ended and open-bottomed housing for the catch means.

3. A device according to claim 2, wherein the catch means is an upwardly cradled and rearwardly stepped lever fulcrumed at a pivot point intermediate its length.

4. A device according to claim 1, wherein the unrestrained other end segment of the rod is a stiffly flexible type of plastic material.

5. A device according to claim 4, wherein the plastic material is a grass trimmer grade of nylon plastic line.

6. A device according to claim 1, wherein the handle member is of comfortably contoured T-formation, with the stem of the T extending forwardly and provided with one member of the ball and socket joint at the forward end of said stem of the T.

7. A device according to claim 6, wherein the trigger is an elongate rigid element pivoted within the handle member at the lower end portion of the cross member of the T by a pivot pin, connected intermediate its ends to the rearward end portion of the stiffly flexible, longitudinal, end segment of the composite rod, and having its upper end portion extending outwardly of the interior of the handle member at the upper end portion of the cross member of the T for down and up movement by a finger of the hand holding the device.

8. A device according to claim 7, wherein a set scew positioned forwardly in the cross arm of the T provides for limiting forward movement of the trigger.

9. A device according to claim 7, wherein the resilient biasing means is a torsion spring anchored about the pivot pin and having arms engaging the handle member and the trigger element, respectively.

10. A device according to claim 1, wherein a wrist strap is secured to the handle member by a tether cord fastened to such handle member.

* * * * *